US006653545B2

(12) United States Patent
Redmann et al.

(10) Patent No.: US 6,653,545 B2
(45) Date of Patent: Nov. 25, 2003

(54) METHOD AND APPARATUS FOR REMOTE REAL TIME COLLABORATIVE MUSIC PERFORMANCE

(75) Inventors: William Gibbens Redmann, Glendale, CA (US); Alan Jay Glueckman, Van Nuys, CA (US); Gail Susan Kantor, Valley Village, CA (US)

(73) Assignee: eJamming, Inc., Boca Raton, FL (US)

( * ) Notice: Subject to any disclaimer, the term of this patent is extended or adjusted under 35 U.S.C. 154(b) by 0 days.

(21) Appl. No.: 10/086,249

(22) Filed: Mar. 1, 2002

(65) Prior Publication Data

US 2003/0164084 A1 Sep. 4, 2003

(51) Int. Cl.[7] ..... G01H 1/18; G01H 7/00

(52) U.S. Cl. ..... 84/615; 84/609; 84/622; 84/649; 84/653; 84/659

(58) Field of Search ..... 84/600–602, 609–612, 84/615–618, 622–625, 626, 634–636, 649–656, 659–660, 666–668

(56) References Cited

U.S. PATENT DOCUMENTS 4,570,930 A * 2/1986 Matheson ..... 463/41
5,292,125 A * 3/1994 Hochstein et al. ..... 463/41
5,350,176 A * 9/1994 Hochstein et al. ..... 463/42
5,685,775 A * 11/1997 Bakoglu et al. ..... 463/41
5,695,400 A * 12/1997 Fennell et al. ..... 463/42
5,820,463 A * 10/1998 O'Callaghan ..... 463/42
6,067,566 A * 5/2000 Moline ..... 709/219
6,175,872 B1 * 1/2001 Neumann et al. ..... 709/231
6,482,087 B1 * 11/2002 Egozy et al. ..... 84/645

OTHER PUBLICATIONS

The Distributed Real–Time Groove Network, (DRGN), copyright 1995. Matthew D moller and Canton Becker.*

* cited by examiner

*Primary Examiner*—Marlon T. Fletcher

(57) ABSTRACT

A method and apparatus are disclosed to permit real time, distributed performance by multiple musicians at remote locations. The latency of the communication channel is transferred to the behavior of the local instrument so that a natural accommodation is made by the musician. This allows musical events that actually occur simultaneously at remote locations to be played together at each location, though not necessarily simultaneously at all locations. This allows locations having low latency connections to retain some of their advantage. The amount of induced latency can be overridden by each musician.

30 Claims, 5 Drawing Sheets

Timings via Direct Connection

212

| To: | A | B | C | D |
|---|---|---|---|---|
| From: | | | | |
| A | 0 | 25 | 50 | 75 |
| B | 25 | 0 | 25 | 50 |
| C | 50 | 25 | 0 | 25 |
| D | 75 | 50 | 25 | 0 |

Timings via Server S

222

| To: | A | B | C | D |
|---|---|---|---|---|
| From: | | | | |
| A | 0 | 125 | 100 | 100 |
| B | 125 | 0 | 75 | 75 |
| C | 100 | 75 | 0 | 50 |
| D | 100 | 75 | 50 | 0 |

METHOD AND APPARATUS FOR REMOTE REAL TIME COLLABORATIVE MUSIC PERFORMANCE

FIELD OF THE INVENTION

The present invention relates generally to a system for electronic music performance. More particular still, the invention relates to a system for permitting participants to collaborate in the performance of music, i.e. to jam, where any performer may be remote from any others.

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO COMPUTER PROGRAM LISTING APPENDICES

The following two appendices are comprised of the respectively listed files, all of which are included on the compact disc filed with this application, and incorporated herein by reference:

APPENDIX A—exemplary application implemented in *Java Studio*, by Microsoft Corporation, using calls to *SERIALIO*, a serial interface class library by Solutions Consulting, Inc., of Santa Barbara, Calif. and the ActiveX *Seer Music Player* by Seer Systems of Los Altos, Calif..

| | | |
|---|---|---|
| About.Java | 10/16/2001 | 3,850 bytes |
| DialUpInfo.java | 10/16/2001 | 7,892 bytes |
| eJamming.Java | 10/18/2001 | 48,699 bytes |
| eJanModem.java | 10/17/2001 | 11,750 bytes |
| InstrumentPicker.java | 10/16/2001 | 10,087 bytes |
| seer.Java | 10/17/2001 | 11,615 bytes |

APPENDIX B—exemplary application implemented in *Visual Basic*, by Microsoft Corporation, using calls to their DirectX version 8.1 API, specifically the DirectPlay and DirectMusic components.

| | | |
|---|---|---|
| DplayCon.FRM | 12/04/2001 | 41,527 bytes |
| Picker.FRM | 12/03/2001 | 6,629 bytes |
| Studio.FRM | 01/07/2002 | 69,087 bytes |

BACKGROUND OF THE INVENTION

In earlier times, a musical education was considered essential. Today, researchers such as Raucher, Shaw and Ky at the University of California, Irvine, study the *Mozart Effect* (*Nature*, vol. 365, pg. 611), and are finding that musical training enhances brain power, especially in spatial reasoning. Congresswoman Louise Slaughter further observed, supporting a rededication to music and art training, that "Those who create do not destroy." Nonetheless, music has been deleted from most elementary and high school curricula and dropped from many extracurricular programs. Private music lessons are expensive and many individuals lack the interest that book learning alone would require.

Personal computers and video game machines are found in most households. A growing fraction of these machines are able to interconnect using modems or the Internet.

Software has long been available to allow a computer to become a musical instrument and to provide music theory instruction. *Practica Musica* (1987), by Ars Nova Software, Kirkland, Wash. is an example of such. This program was sometimes bundled with a plastic keyboard overlay that would temporarily convert a computer keyboard into a miniature white-and-black-keys piano keyboard.

A drawback of such music programs is that they only admit one person at a time. It is desirable to allow students to receive music education using their computers, but to allow multiple students to play together. Further, by allowing the multiple students to be at remote locations (e.g. each in their own home), geography and transportation cost and time cease to be a barrier. Such a capability would allow an online community of music students to interact and collaborate. One should anticipate the formation of "Virtual Garage Bands" and the creation of songs by composers and lyricists who have never met in person.

Historically, computer games only operated for a single player at a time, or for multiple players only at a single location, sharing a single computer. However, there is now a burgeoning market for multi-player games. Individuals with computers or video game machines at separate locations can connect via phone lines or the Internet and cooperate or compete in a computer game. One example of such a game is *MechWarrior* (1995) by Activision, which allows players' computers to connect via phone lines. Another example is *EverQuest* (2001) by Sony Digital Entertainment, where many hundreds of players, each with a computer, connect via the Internet, to a game server owned and operated by the publisher, to play in the same game.

A key difficulty in designing multi-player computer games is the communication latency that occurs between the players' computers. This results in a computerized version of the children's argument, "I tagged you first." "No you didn't, I tagged you first." Two separated computers each accept their own (local) user's input. The computers then communicate those inputs to each other, and finally use both users' inputs to perform a game calculation. However, unless latency (delay) in the communication channel is managed in some way, each computer gives its local user a reaction-time advantage because the other (remote) user is always penalized by the communication channel delay. Eventually, this can result in a disagreement between the two computers—"I tagged you first."

A number of methodologies, each having various virtues and drawbacks, have been developed to solve the communication latency issue for multi-player gaming.

Matheson, in U.S. Pat. No. 4,570,930 teaches a method for synchronizing two computer games. Applicable only to games having discretely calculated "generations", Matheson provides that each generation is numbered, and each generation calculation uses the users' inputs gathered during the prior generation. Matheson's generations may, at best, each be 1/30 of a second long, i.e. at the game's video update rate. However, generations can become arbitrarily long if one or another user's input is not communicated in a timely manner, or needs to be retransmitted. Unfortunately, such a behavior is not conducive to musical performance.

Hochstein, et al., in U.S. Pat. No. 5,292,125, unlike Matheson, shows a technique for continuous play, not requiring Matheson's "generations". Hochstein measures the roundtrip communications transport time between two game stations. Subsequently, each user's input to their local game station is delayed by half the round trip time, but is transmitted to their opponent's station immediately. This meets a "fair game" criteria that Hochstein proposes, by which neither player enjoys a speed advantage over the other.

While the "generation-less" technique is more conducive to musical performance, Hochstein does not address three issues. First, Hochstein does not account for unreliability of the communication channel. Second, simultaneity of players' input is necessary but not sufficient to ensure that game stations remain synchronized. There is the asynchrony of the game station's main loop which will cause divergence in the game state. Matheson understood this. Third, the "fair game" criteria calls for system performance to be degraded to the lowest common denominator. In U.S. Pat. No. 5,350,176, Hochstein, et al. provides synchronization codes which addresses only the first of these. In doing so, he has nearly reverted to Matheson's generations. Bakoglu, et al., in U.S. Pat. No. 5,685,775 provide an alternative synchronization, but at the expense of incurring the entire roundtrip communication transport delay, rather than only a portion.

O'Callaghan is the first to provide the "fair game" criteria for more than two remote stations. Under his U.S. Pat. No. 5,820,463, a collection of two or more stations algorithmically selects a master. All inputs from all stations are sent to the master station, and all are subsequently sent out to each of the other stations for processing. Key drawbacks here, are just as above: performance is degraded to the least common denominator, and a latency of the full roundtrip communication transport delay is incurred.

In U.S. Pat. No. 6,067,566, Moline teaches a method whereby a live musical performance, preferably encoded as well known Musical Instrument Digital Interface (MIDI) commands, can be sent over a network to many stations. The live performance can be selectively recorded or mixed with other pre-recorded tracks. The mechanism is a timestamp that is attached to each musical event (e.g. a MIDI Note-On command). By sequencing the timestamps from separate tracks, the tracks can be mixed. By delaying the mixing for at least the maximum expected delay of the communication channel, the (almost) live musical performance can be added to the pre-recorded tracks at a remote location. Further, a station receiving this performance can play along with the (almost) live performance. Moline is limited, however, in that the "play along" performance is not bi-directional. That is, a true jam session is not taking place. Moline suggests that a repetitive musical pattern could be established and enforced, and that jamming could take place by having each participant hear and play along with the others' performance from one or more prior cycles of the pattern. That play along performance is what would subsequently be heard by the others, during the next (or later) cycle. Such a constraint severely limits the range of artistic expression.

Rocket Network, Inc, of San Francisco, Calif., (www.rocketnetwork.com) allows a similar collaboration model, but without a true real time component. Through their Res Rocket 1.4 MIDI Collaboration software, a player can retrieve a MIDI sequence from a central server, subsequently play along with it and add or modify selected parts, and upload the additions or changes to the server for other collaboration partners to download in turn.

Tonos Entertainment, Inc, of Culver City, Calif., (www.tonos.com) provides a similar capability, but is based on MP3 files, rather than MIDI.

Neumann, et al. in U.S. Pat. No. 6,175,872 does not have such a limitation. By requiring synchronization to a single clock, time stamping of MIDI packets, the streams of MIDI data generated at remote locations can be sent to the local station, sequenced into the correct musical order, and played aloud. The participant playing on the local machine similarly transmits his musical performance, with timestamp, to the other stations. By further requiring that communication transport delay shall be less than twenty milliseconds, Neumann provides real time, remote collaboration and jamming. However, the twenty-millisecond constraint is not met for dial-up users to the Internet, nor even with a direct connection between callers on most local telephone exchanges. Further, the physical limits of the finite speed of light in fiber or cable accumulates at roughly 1 millisecond per 100 miles. Such a requirement, Neumann admits, limits collaborative jamming to a campus-sized WAN. Still, Neumann's contribution allows the merger of multiple remote MIDI streams in another play along environment.

Thus, there is a need for a system that allows multiple musical players, especially music students, to collaborate and jam in real time and over useful distances, such as across neighborhoods, cities, states, continents, and even across the globe.

Because of the delays inherent in communication over significant distances, a technique is needed which does not compound that delay.

Further, there needs to be a way of limiting the adverse effects of excessive delay, and to allow each station to achieve an acceptable level of responsiveness.

The present invention satisfies these and other needs and provides further related advantages.

OBJECTS AND SUMMARY OF THE INVENTION

The present invention relates to a system and method for playing music with one or more other musicians, that is, jamming, where some of the other people are at remote locations.

Each musician has a station, typically including a keyboard, computer, synthesizer, and a communication channel. The communication channel might be a modem connected to a telephone line, a DSL connection, or other local, wide, or Internet network connection.

When musicians desire a jam session, their respective station computers communicate with each other, or perhaps with a designated host computer, and determine the communication delays to and from each other station in the jam.

Subsequently, each musician's performance is immediately transmitted to every other musician's station. However, the performance is delayed before being played locally.

Upon receipt, remote performances are also delayed, with the exception of the performance coming from the station having the greatest associated network delay, which can be played immediately.

The local performance is played locally after undergoing a delay equal to that of the greatest associated network delay.

By this method, each musician's local performance is kept in time with every other musician's performance. The added delay between the musician's performance and the time it is played, becomes an artifact of the instrument. As such, the musician is able to compensate for it and "play ahead" or "on top of" the jam beat.

Sometimes, some of the stations may have a low (good) communication delay between them, while others may have a high (bad) delay. In such a case, each musician can choose to have his station disregard high delay stations during live jamming, and to allow performance with only low delays.

In addition, a "groove" can be distributed to the stations. The groove is a track that provides a framework for the jam session. In its simplest form, it might be a metronome. But it could also be a MIDI sequence, a WAV file (instrumental or lyrical), or an MP3. Regardless of the communication delays, the groove plays in synchrony on all machines, as the command to start the groove is delayed appropriately by each station receiving the play command, and the station issuing the play command.

It is the object of this invention to make it possible for a plurality of musicians to perform and collaborate in real time, even at remote locations.

In addition to the above, it is an object of this invention to limit delay to the minimum necessary.

It is an object of this invention to incorporate the artifacts of communication delay into the local performance in a manner which can be intuitively compensated for by the local musician.

It is a further object to permit each musician to further limit delay artifacts, to taste.

It is a further object of this invention to provide a groove track, against which all musicians can perform.

These and other features and advantages of the invention will be more readily apparent upon reading the following description of a preferred exemplified embodiment of the invention and upon reference to the accompanying drawings wherein:

BRIEF DESCRIPTION OF THE DRAWINGS

The aspects of the present invention will be apparent upon consideration of the following detailed description taken in conjunction with the accompanying drawings, in which like referenced characters refer to like parts throughout, and in which.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE INVENTION

Figure 1:
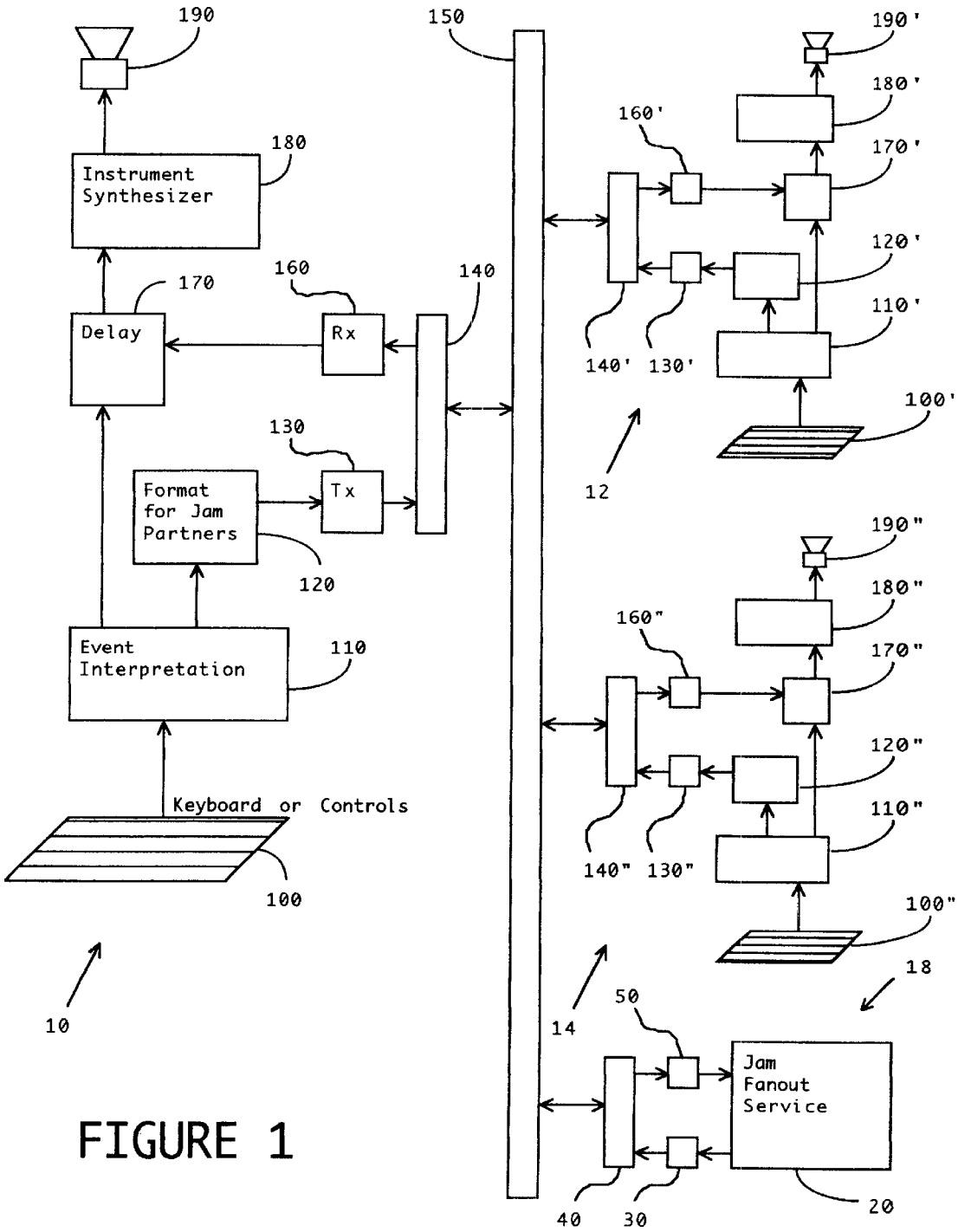
FIG. 1 is a detailed block diagram of multiple musical performance stations configured to jam over a communications channel, and including an optional server.

Referring to FIG. 1, a plurality of performance stations represented by stations 10, 12, and 14 are interconnected by the communication channel 150. The invention is operable with as few as two, or a large number of stations. This allows collaborations as modest as a duet played by a song writing team, up to complete orchestras, or larger. Because of the difficult logistics of managing large numbers of remote players, this invention will be used most frequently by small bands of two to five musicians.

Note that while the term "musician" is used throughout, what is meant is simply the user of the invention, though it may be that the user is a skilled musical artist, a talented amateur, or musical student.

For some implementations, a fanout server 18 is used. Each performance station 10, 12, 14 communicates over communication channel 150 directly with fanout server 18. The fanout server is responsible for forwarding all pertinent communications from any of the performance stations to each of the others.

Communications channel 150 may be a telephone network, a local or wide area Ethernet, the Internet, or any other communications medium.

In FIG. 1, each of remote performance stations 12 and 14 mirror the elements of local performance station 10. Each of performance stations 12 and 14 have keyboard and controls 100, 100', 100", event interpretation 110, 110', 110", event formatting for jam partners 120, 120', 120", transmit module 130, 130', 130", communication channel interface 140, 140', 140", receive module 160, 160', 160", delay 170, 170', 170", instrument synthesizer 180, 180', 180", and audio output 190, 190', 190", respectively.

Each performance station is preferably comprised of a personal computer having a keyboard and controls 100. Other common graphical user interface (GUI) controls, such as on-screen menus and buttons operated with a mouse or trackball, are included in keyboard and controls 100, but not specifically illustrated here.

Certain keys of keyboard 100 are mapped to certain musical notes as explained below in conjunction with FIG. 3.

The keys of keyboard 100, when operated, generate events. When a musician presses a key on the keyboard, a "key pressed down" event is generated when the musician lets go of the key, a "key released" event occurs. Similarly, if the computer's mouse is clicked on an on-screen button, a "button pressed" event is generated.

A more expensive alternative to the computer keyboard is a MIDI controller. Usually resembling a piano keyboard, though often smaller and covering fewer octaves, a MIDI controller is more intuitive and musically friendly than the computer keyboard. When combined with a MIDI interface for the computer, such as the one provided with well known audio cards such as Creative Labs' Sound Blaster, the MIDI controller can generate events in place of or in addition to keyboard and controls 100.

Importantly, if one or more MIDI controllers are added to the keyboard and controls 100, it becomes possible for more than one musician to perform at a single performance station 10. That is, if a single MIDI controller is added to performance station 10, then one musician could play the MIDI controller, and another musician could play using the computer keyboard. Each additional MIDI controller added to keyboard and controls 100 can potentially allow an additional musician to play at the local performance station. Throughout this discussion, references to the musician using a performance station will be understood to include the possibility of multiple musicians performing on that single performance station.

Each of the stations 10, 12, and 14 may be identical, or may have different keyboard and controls 100, 100', 100" as described above.

Hereinafter, when relating to the generation of a musical event, the term "keyboard" may be used to refer to the computer keyboard, a MIDI controller, or the GUI or other controls.

When an event is generated by keyboard and controls 100, whether from a computer keyboard, MIDI controller, or a mouse action, the event is interpreted. Event interpretation 110 examines the event to determine whether it has significance to the musical performance.

An example of a significant event would be "key pressed", where the key has been given an association with a musical note that should be played. A "key released" for the same key would mean that the note, if playing, should be stopped. The same is true if the event comes from the MIDI controller.

An example of a non-significant event would be a "key pressed", where the key is not assigned to a note.

For this invention, non-significant GUI events would include, for example, mouse actions that take place outside the GUI 300, discussed below in conjunction with FIG. 3.

Events determined to be musically significant by Event Interpretation 110, are immediately sent two places: Musical events are formatted for the jam partners at 120, and subsequently the transmit module 130 packages the musical events for the communication channel, possibly merging them with packet from other sources (not shown, discussed below), and advances them via the communication channel interface 140 to the communication channel 150. Also, the musical events are directed to the local instrument synthesizer 180 by way of delay 170, discussed below, to be rendered by audio output 190.

Distributed multi-player game software is well known in the art. Those skilled in the field will be familiar with a modern personal computer running the Windows operating system by Microsoft Corporation, Redmond, Wash., further having Microsoft's DirectX real time extensions, including DirectPlay—Microsoft's extension for distributed multi-player games. With such an implementation, the formatting for jam partners 120 preferably consists of a single call to the SendTo method in the DirectPlay API for each musical event. Data representative of the musical event is provided to the method, along with a command code to send the event data to all other stations.

When implemented using DirectPlay, the transmit module 130 is comprised of the DirectPlay session. The DirectPlay session can operate with any of several interconnection technologies, including serial, modem, and TCP/IP, among others. Source code for an exemplary implementation using DirectX is given in Appendix B.

Microsoft's DirectPlay API notwithstanding, an implementation of the functionality of the SendTo method is within the capability of a skilled programmer, just writing directly to the transmit module 130 as a managed buffer for the communication channel interface 140. Similarly, an implementation of the transmit module 130 without the DirectPlay library is within the skilled programmer's capability. Source code for an exemplary implementation not using Directx is given in Appendix A.

While many other alternative implementations of the communications channel 150 can be selected, the following discussion covers the two specific cases where the communications channel 150 is implemented as a telephone modem, and a TCP/IP network. Examples of implementations not discussed in detail include RS-232 serial networks, where a jam fanout server 18 is required for a jam having more than two participating performance stations); RS-485 or similar multi-drop searial networks, where a jam fanout server 18 is not requiread; a packet radio network; and other form of LAN or WAN networks, such as token ring, or IPX. This list is not intended to limit the scope of the present invention, but merely to illustrate that essentially any communication channel can be used.

If implemented using a modem (whether using DirectPlay, another library, or custom coded software), then the transmit module 130 contents are written out to the communication channel interface 140, implemented as a modem, for transmission on communication channel 150, implemented as a telephone line. In this implementation, the communication channel will connect performance station 10 to exactly one of the other performance stations 12 or 14, or to a fanout server 18.

In the case of a jam including only two musicians, for example using only performance stations 10 and 12, communication channel interfaces (modems) 140 and 140' can connect with each other directly over communication channel (telephone network) 150 without resorting to fanout server 18. This is well understood, as one modem, for example the communications channel interface 140 of performance station 10 is placed into a waiting-for-call mode, while the other modem, the communications channel interface 140' of performance station 12 dials the former modem's telephone number.

Since a telephone modem can connect to only one point at a time, for connecting more than two musicians using a telephone network as the communications channel 150, each performance station 10, 12, and 14 participating in a jam will connect to a common fanout server 18.

The fanout server 18, when operating with a telephone modem implementation, is comprised of a plurality of modems 40 (only one shown), each having an associated transmit module 30 and receive module 50. The plurality of modems are all placed into waiting-for-call model. The modems 140, 140', 140"of each participating performance station 10, 12, and 14, respectively, dial the number for the jam fanout server 18 and are each connected to a different one of the plurality of modems (of which modem 40 is one) of fanout server 18. Packets received at each receive module 50 are processed by jam fanout service 20, and forwarded to other stations by writing them to each appropriate transmit module 30. The packets are then sent to the participating performance stations 10, 12, 14, excluding the station having originated the packet.

This kind of service is well known, and has long been used for multi-player games. Further, this body of knowledge has been distilled, well documented, and released in one readily available form as Microsoft's DirectPlay API.

As an alternative implementation, those skilled in the art will recognize the fundamental operation of a modem-based bulletin board system (BBS) having a chat room function. The trivial adaptation being that data representative of a musical event is transferred, rather than human-entered text messages which are readably displayed to other chat room participants.

An advantage of using modems as the communication channel interface 140, 140', 140", and the plurality of 40, communicating over the telephone network as the communication channel 150, and using a BBS implementation of fanout server 18, is that the delay imposed by the telephone network is typically smaller and more stable than that found in switched packet data networks, such as the Internet.

In an implementation where communication channel 150 is a TCP/IP network, then transmit module 130 includes the TCP/IP stack, and perhaps other software such as the DirectPlay session object when DirectPlay is being used. Communication channel interface 140 may be a modem dialed into an Internet Service Provider (ISP) and operating the Point-to-Point Protocol (PPP) to connect with and use the Internet as communication channel 150; a cable modem, DSL, or other communication technology can also be used. Interface 140 may be a network interface card (NIC), connected, for example, using 10baseT to reach a hub or router. Whether the TCP/IP network actually connects to the Internet, or merely to a private network, the invention is operational if musicians at the participating stations 10, 12, and 14 can interconnect over the communications channel 150. When connecting over a TCP/IP network, each performance station 10, 12, and 14 may send musical event messages directly to each of the others. Alternatively, a jam fanout server 18 may be used. Another alternative is to use a multicast protocol to send each message to the other stations.

In an implementation using a jam fanout server 18, it is necessary for each participating performance station to know how to contact the fanout server 18, and how to inform the fanout server of the interconnection desired.

The previous discussion illustrates that regardless of the implementation of communication channel 150, performances stations 10, 12, and 14 are able to exchange musical event information. The following discussion assumes that the wide variety of implementations available is understood, and for clarity merely concerns itself with the management of the musical event messages, and the timing characteristics of the connection between each two stations 10, 12, and 14 over communication channel 150.

Packets are received by communication channel interface 140 and provided to receive module 160. Many kinds of packets may be seen, but only those representing musical events from participating performance stations are advanced to delay 170 (discussed below), and ultimately played over instrument synthesizer 180 and audio output 190. Other messages which do not qualify for this treatment, are handled by other means (not shown).

Several varieties of non-musical packets are contemplated, and serve to add functionality and versatility to this invention. Among the functions possible are an intercom, performance station state setting commands, and communication channel delay measurement. Each of these is discussed below. When receive module 160 gets one of these packets, it is handled in a manner described below.

Delay 170 receives musical events generated by the local musician (not shown) at local performance station 10, operating on the keyboard and controls 100 and accepted by event interpretation 110. It also receives musical events generated by remote musicians (not shown) at remote stations 12 and 14, using those keyboards and controls 100' and 100", which were processed similarly and communicated to performance station 10 as described above.

By a value that will be specified below, each musical event received by delay 170 is held for a (possibly null) period of time, before being provided to instrument synthesizer 180.

Delay 170 can be implemented as a scheduled queue, where each event entered into the queue is given a delay time (to be defined below). The event is to remain in the queue for that delay time, and then be advanced from the queue to the instrument synthesizer 180.

One example implementation for delay 170 is to use a sorted queue. Upon receipt of a musical event by delay 170, the musical event is augmented with a future time value, calculated by adding a delay value (selected in a manner described below) to the current time. The musical event with the appended future time is inserted into the sorted queue in order of ascending future time. Delay 170 further operates to ensure that, at the time listed as the future time of the first event in the queue, the first musical event is removed from the queue and sent to the instrument synthesizer 130. An example of source code for this implementation is included in Appendix A.

An alternative implementation of the same delay 170 is illustrated in Appendix B. Here, the delay 170 is partially implemented by the DirectX DirectMusic API. The future time is calculated in the same way, but the future time is then passed as a parameter, along with the musical event data, to the appropriate DirectmusicPerformance method, for example the SendMIDIMSG method, to schedule musical events such as MIDI Note-On or -Off, or the PlaySegmentEx method, to schedule musical events such as the playing of a particular audio file.

Many implementations of instrument synthesizer 180 are possible. The synthesizer can be entirely composed of software, as with the *Seer Music Player* by Seer Systems of Los Altos, Calif. Alternatively, a dedicated hardware synthesizer can be used, such as any of the Creative Labs Sound Blaster series, which is a card added to a personal computer. Some computers have integral synthesizers. Alternatively, if the computer is provided with a MIDI output port, the synthesizer can be external to the computer, and receive musical events as a MIDI stream coming from a MIDI output port. Further, the term "synthesizer" is not used in a limiting sense. Herein, it is used to indicate any controllable musical device. Examples include systems capable of waveform playback, such as audio samplers and media players, and even automated acoustic instruments such as a MIDI controlled player piano. True synthesizers, such as analog or FM-synthesizers (digital or analog) are also included.

The implementation details of any of these alternatives is within the capability of a skilled programmer. Further, Microsoft's DirectMusic API provides an implementation independent software interface to any of these options. The actual synthesizer arrangement can be selected by the musician operating the personal computer, and the application implementing the performance station determines the correct instrument synthesizer 180 at runtime. Exemplary code for such an implementation is given in APPENDIX B.

Another implementation, using the Seer Music Player, is shown in APPENDIX A.

Figure 2A:
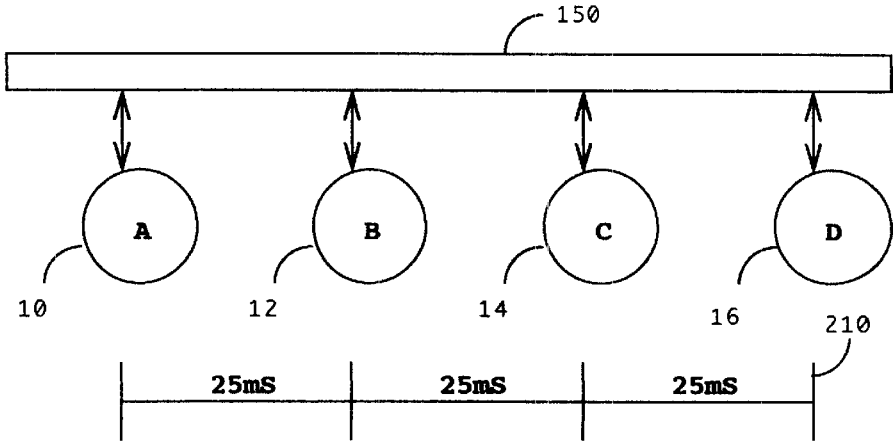
FIG. 2A is a schematic of multiple musical stations connected over a simplified communications channel topology to illustrate the effect of communications delay.
Figure 2B:
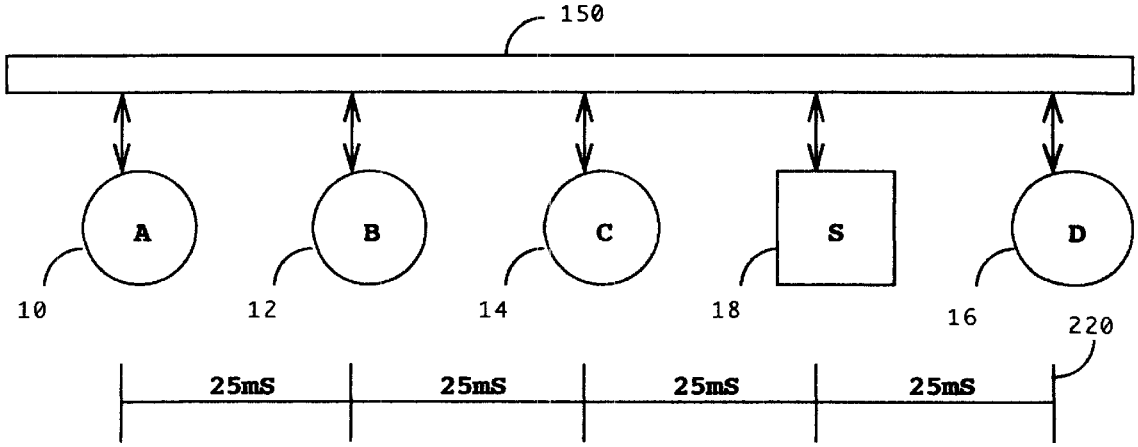
FIG. 2B is a schematic like that of FIG. 2A, but illustrating the added effect of a server.

FIGS. 2A and 2B illustrate how to obtain the data needed to determine the delay value applied to each music event message by delay 170. The formula for the delay value is given below.

Referring to FIG. 2A, an idealized connection topology for four performance stations A, B, C, and D (10, 12, 14, and 16 respectively) is shown. No regard is given for the exact nature of the communication channel 150, except that each performance station 10, 12, 14, and 16, can connect directly with any other.

In this example topology, the communication delay is considered proportional to the distance between each performance station. To clarify, scale 210 shows an exemplary 25 milliseconds between each adjacent pair of performance stations. Thus, performance stations A and C (10 and 14), would have a 50 millisecond communication delay between them.

The resulting communication delays for communication between any two performance stations is shown in table 212.

As well known in the prior art, a good estimate of a communication delay can be made by measuring how long it takes for a message to make a round trip between two stations. A commonly used measurement is made with the ping protocol, but custom messages implemented from within the application can give a more representative measurement. An estimate is made better by averaging the round trip time for many such messages. In the examples shown in APPENDICES A & B, the first few rounds of the message are ignored for the purpose of measurement. This is because the first time the routine to conduct the measurement is called, it will almost certainly not be in cache, and perhaps even be in swappad-out virtual memory, and therefor will run with an unusual, non-representative delay. Subsequent calls will operate much more efficiently. If the code is written in a language such as Java, and is running under a just-in-time (JIT) compiler, the first call to the routine may result in a compilation cycle, which will not subsequently be required. By ignoring the first few cycles of the communication channel delay measurement message, the measurements are more likely to be representative of the steady-state value for the communications delay between two stations.

Note that while the delays illustrated in FIG. 2 are symmetrical, that is the delay from Station A to Station C is the same as from Station C to Station A, that is not necessarily the case. For most cases, the methodology above will be quite adequate. However, sufficiently rigorous methodology can discern non-symmetrical delays. However, such a result would only cause the upper and lower triangular sub-matrices of table 212 (or 222) to be non-symmetrical. The subsequent discussion and use of the tables would be the same.

It is interesting to note that the diagonal of the table 212 (and 222) is all zeros—that is, the time it takes a performance station to communicate to itself a musical event is essentially zero—this is because the musical event message does not need to travel over the communication channel 150. The actual delay is, of course, some small non-zero value, but when compared with the delays of the communication channel, the local delay is insignificant.

FIG. 2B illustrates a different topology. Here, each of the four performance stations A, B, C, and D (10, 12, 14, and 16) communicate with each other only through a fanout server S, 18. The communication delay between any two performance station is the sum of the communication delays between each station and the fanbut server 18. For example, the communication delay from Station A 10 to Server S 18 is 75 milliseconds, as shown by scale 220. The communication delay from Server S 18 to Station B 12 is 50 milliseconds. Therefor, the total communication delay is 75+50=125 milliseconds. This result can be seen in the table 222, in the first row (representing messages travelling from Station A) at the second column (representing messages travelling to Station B), where the entry reads '125'.

In the topology of FIG. 2B, the fanout server S 18 can undertake to measure the communications delay between itself and each of the performance stations 10, 12, 14, and 16. The results of those measurements can be provided to all of the performance stations. The sums of the delays between each of two stations and the fanout server S 18 can be used to populate the value for each value in the table (with the diagonal elements being held to zero, as above.)

The values of the communication delay table 212 or 222 are best measured empirically, by the methods known to the art, with the precaution mentioned above. Once obtained, the contents of the table can usually be considered fixed, for relatively stable situations. Alternatively, the table values can be continuously updated to reflect dynamically changing load placed by unrelated traffic on the communication channel 150.

Each performance station A, B, C, or D is interested only in the column representing the time it takes for messages sent by other performance stations to reach it. This is contrary to the "fair game" criteria of the prior art, where the whole table had to be considered.

When a musical event message is sent to delay 170, it is associated with a delay value. If the musical event message comes from the local event interpretation (110 for performance station 10, 110' for performance station 12, etc.), then the delay value is maximum value in the table column for that performance station. That is, local musical events are artificially delayed by delay 170 for the same amount of time that it takes for a message to arrive from the (temporally speaking) furthest participating performance station.

For example, assume the topology of FIG. 2A is employed. A musical event is generated by the musician at performance station B 12. The delay value set by delay 170' is the maximum delay found in column B of the delay table (212), that is, 50 ms: the communication channel delay measured for Station D 16.

In the other case, when a musical event message comes from a remote performance station, then the delay value is calculated as the maximum value in the table column for the receiving performance station, less the value in that column for the transmitting station. That is, a remote musical event is artificially delayed by delay 170 for enough additional time to equal the amount of time that it takes for a message to arrive from the (temporally speaking) furthest participating performance station.

For example, assume the topology of FIG. 2A is again employed. A musical event is generated by the musician at Station A 10. The musical event message is sent via communication channel 150 and is received by Station B 12. The delay value set by delay 170' is the maximum delay found in column B of the delay table 212, again 50 mS, but less the time it took the message to travel from Station A to Station B that is row A of column B, or 25 mS. The resulting delay value is 50−25=25 mS.

It is important to note that the effects of communication channel delay for some performance stations that are centrally located (e.g. Stations B & C in FIG. 2A) are less than for some other more remote performance stations (e.g. Station A in FIG. 2A). That is, the worst case delay for Station B 12 in FIG. 2A is the maximum value of column B in table 212: 50 mS. The worst case delay for Station A 10 in FIG. 2A is the maximum value of column A in table 212: 75 mS. This is contrary to the "fair game" criteria of the prior art, which would have the worst delay value be the same for all stations (i.e. the maximum value in the delay table.)

An alternative behavior for delay 170, is to select a maximum delay that a performance station will support. For example, the musician of performance station A 10 in FIG. 2A may elect to set the maximum supported delay to be 60 mS. When calculating the delay value, only values less than the maximum supported delay value will be considered. Thus, since (as seen in column A of table 212) only stations B and C are within the maximum supported delay, only those values will be considered when calculating the maximum delay. Thus, the delay applied to local musical events at Station A becomes 50 mS (the maximum value in column A less than 60 mS), where otherwise it would have been 75 mS (the maximum value in column A). Musical events received from the remote performance stations B, C, and D have delay values calculated for them as before, but using the constrained maximum value of 50 mS (the maximum value in column A of table 212, less than the selected maximum supported delay of 60 mS). As a result, the delay values calculated for musical events received by Station A 10 from Stations B, C, and D are 25 mS, 0 mS, and −25 mS, respectively. The negative delay value calculated for Station D indicates that the musical event received from Station D should have been sent to the instrument synthesizer 180, 25 mS before it was received at Station A 10, which is clearly impossible.

In the case of musical events received for which the delay value is calculated to be a negative value, there are several choices available. The first is to react to the event as if the calculated delay was zero—play the note now, stop playing the note now, etc. Alternatively, policy can be set depending upon the command in the musical event: ignoring the musical event may be suitable for a note on command; responding to the musical event may be suitable for state altering events (e.g., change instrument). Another alternative is to ignore all musical events having a negative delay value, or having a sufficiently negative one. For example, musical events that are received up to 20 mS late (a negative delay value between 0 and −20 ms) may be acceptable, but musical events later than that (having delay value less than −20 ms) would be ignored.

The result of delay 170 causing local musical events to be delayed before they are sent to the instrument synthesizer 180, is that the instrument takes on an additional quality of prolonged attack. That is, the time from when a musician presses a key to the time the instrument sounds is increased by the delay value. For larger values of the delay value, this can be perceptible to even a novice musician, e.g. a 1000 mS delay would result in the instrument sounding one full second after the key has been pressed. However, for smaller values of the delay, say, less than 100 mS, a novice musician is not terribly disturbed by the delay. Experienced musicians can adapt to delay values of 60 mS readily. While no delay is desirable, an experienced musician can adapt to this new "property" of a musical instrument, and play "on top of" the beat to achieve a satisfying musical result.

The tradeoff made by each musician in a remote jam session is just how much delay each is willing to tolerate. As the maximum supported delay is reduced at a station, those remote stations whose delay value is calculated to be negative will either no longer be heard, or will be heard later.

Another alternative embodiment of delay 170 makes use of the same delay values from delay table 212 or 222. In addition, however, during the initialization of the delay tables, when messages are being sent back and forth between the performance stations to characterize the communication channel delays, each performance station includes in the message the value of its clock, which should have a resolution of about one millisecond, though ten millisecond resolution can suffice. Each time this clock augmented ping-like message is exchanged, not only is the local estimate of the communication channel delay updated, but so is an estimate of the remote station's clock. In this manner, not only is the local performance station able to estimate that the delay in a message from a particular remote performance station, but it also can determine how far ahead or behind that remote performance station's clock is running. In this implementation, a musical event includes the clock time of the transmitting performance station. Thus, when a remote musical event is received, rather than adding the delay value to the current local time, the delay value is added to a computed local time, generated by adding the measured offset of the remote performance station's clock. This implementation is particularly useful for environments where delays in the communication channel are highly volatile. In this way, fluctuations in the actual communications channel delay are removed. Note, however that an uncommonly long communications channel delay may cause the sum of the computed local time and the delay value to fall in the past. In such a case, the musical event can be ignored, or if the lateness does not exceed a threshold, the note can be played immediately, even though it arrived too late.

An exception to the use of a maximum supported delay is the starting of a groove track. The instrument synthesizer 180 includes the ability to play a groove track. Preferably, the groove track is stored as a WAV or MP3 audio file, and thus can include instrumental and lyrical performance. Alternatively, the groove track can be stored as a MIDI sequence, which has the advantage of compactness.

It is preferable that each performance station 10, 12, 14 and 16 possess a local copy of the same groove track file. The selection of a groove track file (a non-musical event) at one performance station causes a groove track file selection event message to be propagated to each of the other performance stations.

When the groove track file selection event message arrives at receiver module 160, 160', and 160", the message handler determines whether that file is available on the local machine. If so, it is prepared as the current local groove track file, and an acknowledgement is sent. If it is not available, an error message is returned both to the local performance station, and because of a negative acknowledgement message returned, to the performance station having made the selection.

Alternatively, the groove track selection event may contain information (such as a URL) for finding the groove track file on the Internet. Another alternative is for the groove track to be transmitted with the selection event message, though this makes for a heavy message. Still another alternative is for the station making the groove track selection to begin streaming the groove track file to each of the other performance stations, in which case, the performance stations receiving the streaming file begin buffering it.

Once all performance stations have affirmatively acknowledged that the groove track is available and ready, any station can issue a musical event to start playing the groove track.

As was previously mentioned, the musical event starting a groove track is an exception to the maximum supported delay value. Regardless of the setting for the maximum supported delay, the delay value for the start of the groove track will be calculated by delay 170 as if no maximum supported delay were set. This insures that all participating performance stations 10, 12, 14, and 16 will start their groove track simultaneously, regardless of which performance station issues the start groove track musical event. By ensuring that all groove tracks have started simultaneously, all performance stations share a common reference for the distributed musical performance.

Figure 3:
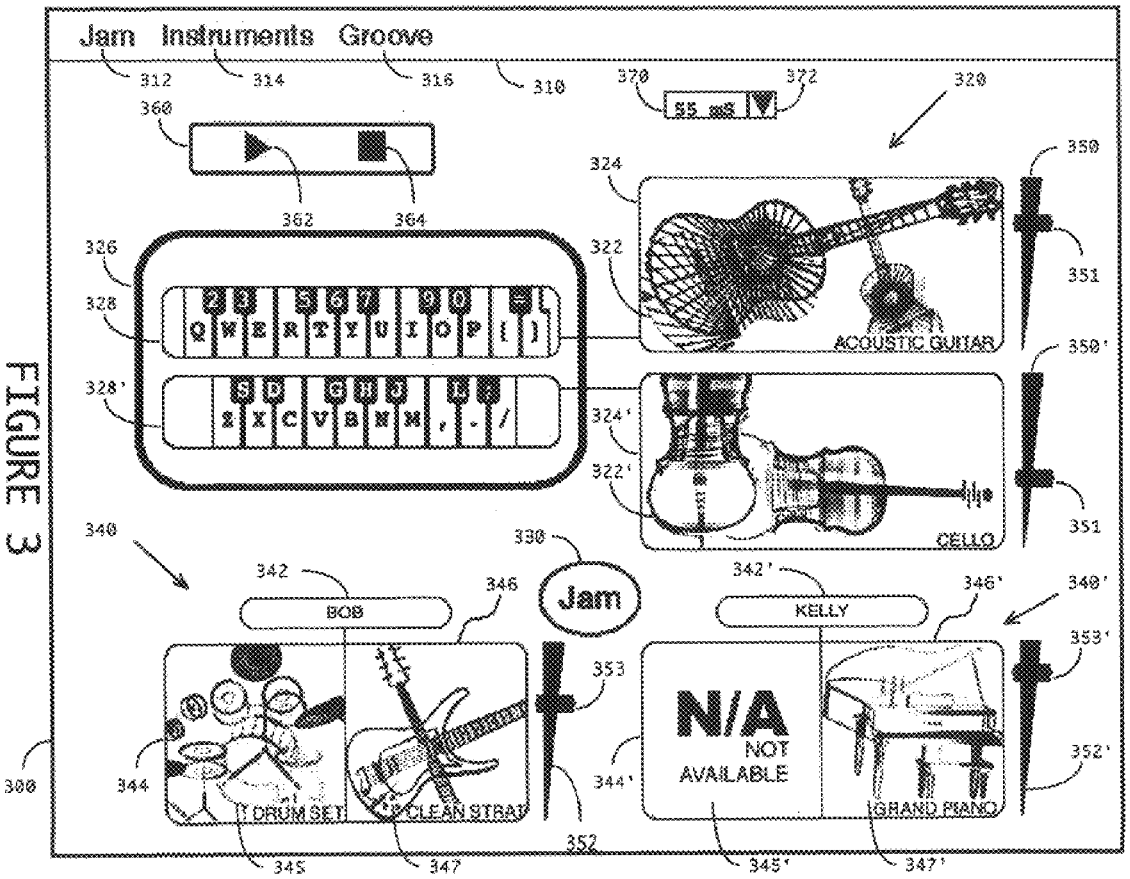
FIG. 3 shows the preferred graphical user interface for remote jamming.

The preferred graphical user interface 300 is shown in FIG. 3. Optionally, the functions of the invention are made available through a menu bar 310 having menu items 312, 314, and 316.

The middle portion of the display is preferably the local performance station status area 320. The lower portion of the display contains the remote performance station status areas 340, 340'.

In the preferred embodiment, the local performance station status area 320 provides a local first instrument indicator 324, and local second instrument indicator 324'. Each indicator shows an image of the currently active instrument 322 and 322', Control selection region 326 contains control indicators 328 and 328' for the respective first and second local instruments. In the case where a computer keyboard is employed for playing music, the control indicators 328 and 328' preferably show which computer keyboard keys correspond to which notes on a chromatic scale. For example, the control indicator 328 for the local first instrument, an acoustic guitar as shown by local first active instrument 322 (to be synthesized by local instrument synthesizer 180), shows that the 'Q' key of the keyboard will play a middle-C, and that the '2' key will play the sharp of that note. Releasing the keys will stop the playing of the respective notes.

Control indicator 328 suggests a limited range when a computer keyboard is employed as a chromatic keyboard. To overcome this limited range, the SHIFT, CONTROL, and ALT modifier keys are preferably used. The SHIFT key can be assigned the function of raising the whole keyboard by one octave, and the ALT key by two octaves. The CONTROL key commands a drop of one octave. In this way, the musical range of the computer keyboard is expanded to over four octaves. Combinations of the modifier keys preferably select the highest modification from those selected. In the alternative, they could be combined to extend the range even further. A complication can occur if a note key, say the 'Q', is pressed, followed by the SHIFT key being pressed in anticipation of some future note, after which point the 'Q' is released. The intent is that the middle-C originally played in response to the 'Q' being pressed, should be ended. In order to insure that this happens, when a key assigned to a musical note is released, all musical notes that were initiated by that key (regardless of the condition of the modifier keys), are released. This prevents musical notes from appearing to stick. This is not an issue for musical events generated by a MIDI controller.

If no instrument is currently selected, then currently active instrument displays 322 and 322' would indicate that with a "Not Available" image similar to the image of the second remote player's first currently active instrument 345'.

Alternatively, when a MIDI keyboard is used as keyboard 100, for example to control the local first instrument, the respective graphic indicator 328 would indicate the MIDI keyboard and MIDI channel.

Figure 4:
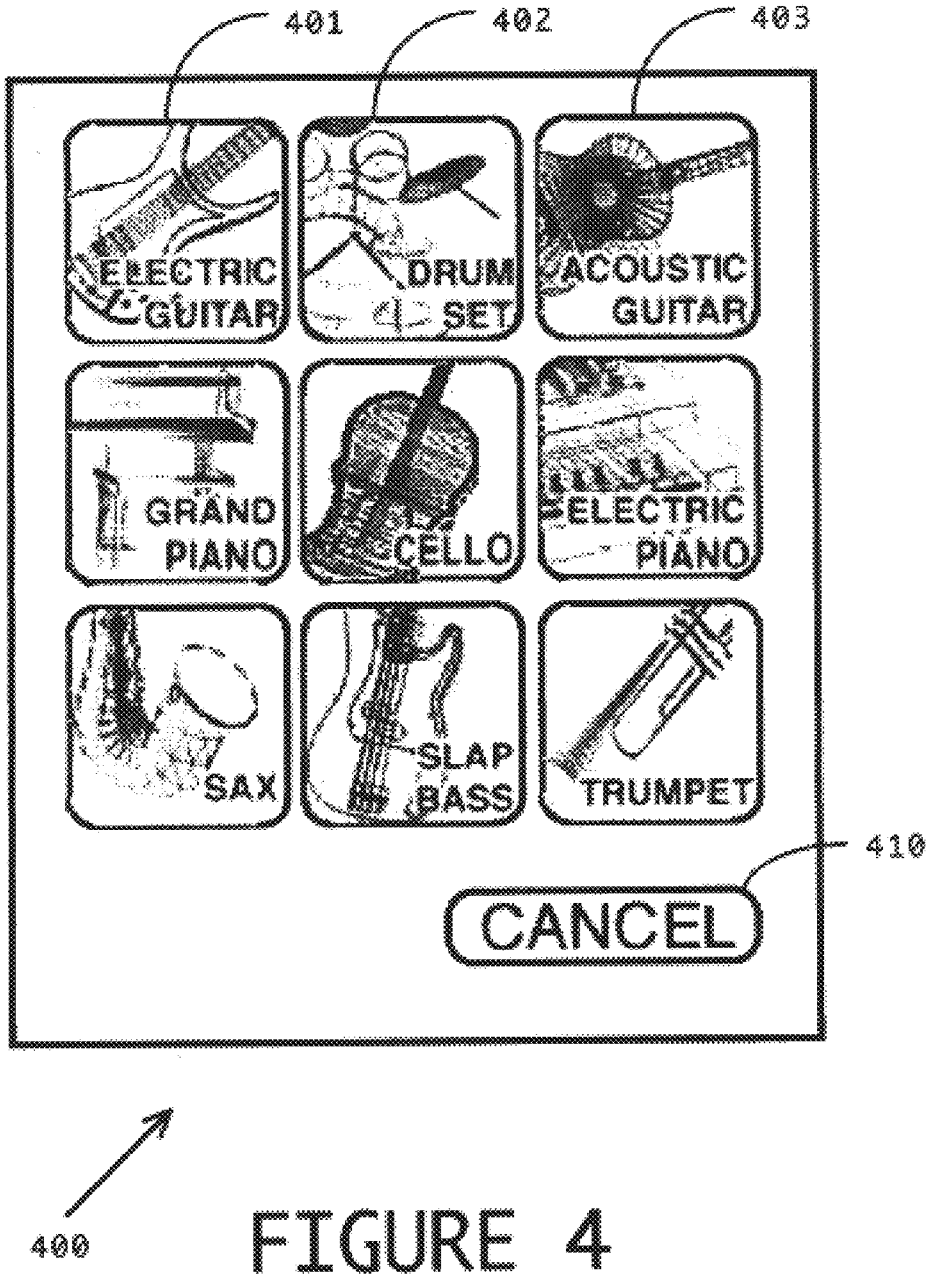
FIG. 4 depicts an instrument picker.

Selection of alternative controls or active instruments can be made through the Instruments menu item 314, or by direct manipulation of elements of the control selection region 326. For example, clicking on the first local instrument control indicator 328 can call up an instrument selection dialog 400, shown in FIG. 4. The clicking of any instrument choice button 401, 402, or 403 (or any others not called out) will immediately cause that choice to become the active instrument for the local first instrument and the first currently active indicator 322 would be updated to reflect the new choice. Pressing the cancel button 410 causes no change to be made to the active instrument.

Preferably, an implementation uses a MIDI representation—at least internally. If so, then the result of an instrument selection is a voice assignment to a MIDI channel. The local first instrument can be implemented as MIDI channel 1, the local second instrument as MIDI channel 2, the first remote musician's instrument selections are on MIDI channels 3 & 4 respectively, and the second remote musician'instruments selections are on MIDI channels 5 & 6.

Returning to FIG. 3, in remote performance station status areas 340 and 340', each remote musician's name is displayed in remote musician displays 342 and 342'. The remote musicians' first instrument indicators 344 and 344', and second instrument indicators 346 and 346' contain images of their currently active instruments 345, 345', 347 and 347' respectively.

Before the local performance station has established a connection with any remote performance station, the remote performance station status areas 340 and 340' may be hidden, or if displayed the remote musician displays 342 and 342' may indicated connection status (e.g. "waiting . . .")

Volume controls 350, 350', 352, and 352' are adjusted using the sliders 351, 351', 353, and 353' respectively. Each adjusts the volume with which the nearby instrument or instruments is played. Thus, for example, volume control 350 sets the overall volume for the local first instrument, and volume control 352 sets the overall volume for the first remote player's instruments. Preferably, in a MIDI implementation, the volume setting is used as the "velocity" parameter in MIDI Note-On commands. Further, the volume settings at the remote performance stations have no effect on the volume at the local performance station.

Alternatively, the volume settings 350 and 350' at a remote performance station can be combined with the local volume setting 352 for the remote performance station (realizing that the graphical user interface 300 is separately displayed at each performance station 10, 12, 14, and 16, and at each performance station).

Alternatively, if a velocity sensing MIDI keyboard is employed for keyboard 100, then the velocity parameter of the MIDI Note-On commands resulting can provide a separate volume value for each keypress. When this is done, the velocity values can be combined with the appropriate volume control so that the volume control is able to raise or lower the volume of the instrument relative to the other instruments.

Volume control is an important feature, as it allows a musician to emphasize an instrument of interest, and to de-emphasize instruments (or musicians) that are distracting or otherwise detracting from the local musician's enjoyment.

Alternatively, separate volume controls can be provided for each remote instrument.

The Groove menu item 316 allows a musician to select a previously prepared musical track to be played. The groove may be stored as a WAV file containing audio waveform data, or as an MP3 or other compressed sound format. Such audio files are especially well suited to lyrical grooves (i.e. a groove that includes a singer), or to allow musicians to jam to a pre-recorded audio track. Alternatively, the groove may be stored as an MID file, i.e. a MIDI sequence file. Such file formats, and others, and the methods for playing them back are well known in the art, and supported by commonly available operating systems and APIs, such as DirectX.

Once a groove file has been selected, the groove playback control panel 360 becomes active. The groove playback control panel 360 contains a play button 362, and a stop button 364. When play button 362 is pressed, a musical event is generated which, after an appropriate delay introduced by delay 170 and described above, will cause the groove to start playing. Similarly, stop button 364 will cause the groove to stop playing.

The Jam menu item 312 allows the musician to prepare the local performance station for a jam session, and optionally select remote jam partners. This same functionality is preferably available by clicking jam button 330.

In one implementation, a first musician at local performance station 10 presses jam button 330 and responds to a dialog that the local performance station 10 is to anticipate incoming remote jam requests. Such dialogs are well known in the art. For example, under Microsoft DirectX, the DplayConnect object has a StartConnectWizard method which provides all necessary dialogs.

In particular, for performance stations capable of accessing more than one communication channel 150, a first dialog requiring selection of a communication channel is preferred. In the case of a modem connection, the modem is thereby instructed to answer the phone. Subsequently any communications received by the modem are passed to the local performance station software. In the case of an Internet connection, an IP port is prepared and begins listening for connections by remote performance stations. Such behaviors are well understood, and are demonstrated by the software of APPENDICES A & B.

Once the first musician has directed the local performance station 10 to anticipate incoming jam requests, any other musicians at remote performance stations 12, 14, and 16, by pressing the jam button 330 or selecting menu item 312, can direct their respective stations to connect to performance station 10.

In a manner similar to that of the first musician, the other musicians direct their respective remote performance stations to use the appropriate communication channel 150, if more than one is available. The communication channel selected (or the only one available) must be the same communication channel 150 selected for use by the first musician. Subsequently, the remote performance stations 12, 14, and 16 must be provided with an address for the first musician's performance station 10. Preferably, this is done with a dialog asking for a phone number in cases of a modem connection, or for an IP address in cases of an Internet connection. This behavior, too, is well known and even provided in the DirectX StartConnectWizard method mentioned above. Further, these behaviors are well understood, and are demonstrated by the software of APPENDICES A & B.

Preferably, a delay display 370 shows the maximum delay detected and used by delay 170 to delay musical events originated at local keyboard and controls 100 before they are provided to local instrument synthesizer 180 to be played. For example, for performance station A 10, in tables 212 and 222 (depending, the maximum delay value listed in column A would appear in delay display 370.

Alternatively, delay values list pulldown 372, when pressed, would display the list (not shown) of delay values currently observed for each participating remote station 10, 12, 14, 16. For example, for performance station A 10, this would be the list of values in tables 212 or 222, column A. Preferably, the list of delay values is sorted in ascending order. Also, the current selection for maximum delay value would be highlighted. Optionally, the list can include the name of the associated musician next to each remote station delay value. By picking one of the delay values associated with a particular remote station, the musician can set a local maximum supported delay for the local performance station. Note that the operation of drop down lists and other methods for a user to select a value are well known.

In still another alternative embodiment, an additional control can be added to allow the local musician to directly specify the maximum supported delay. This might be implemented as a dial or slider, and may drive the value displayed in delay display 370 directly.

Figure 5:
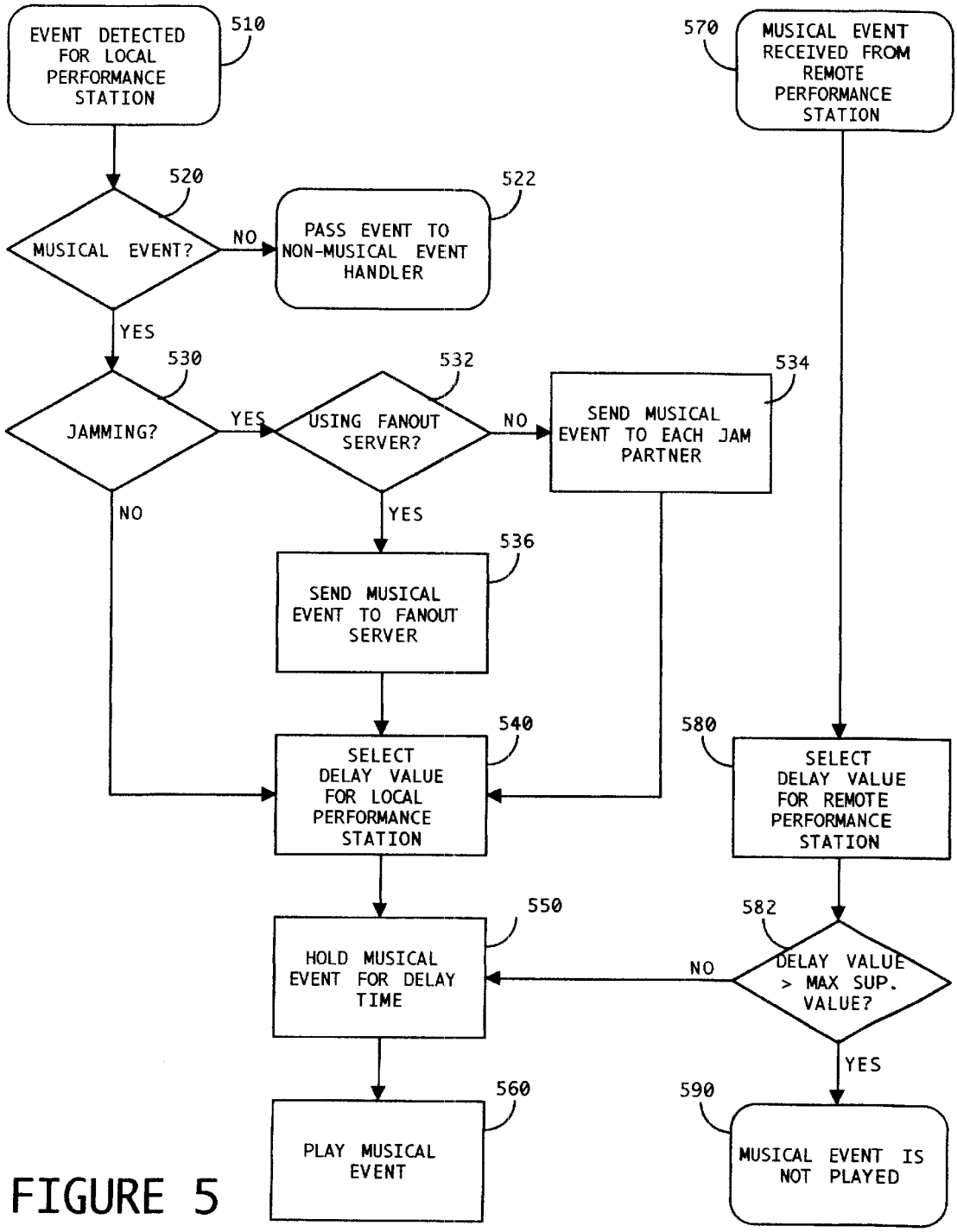
FIG. 5 is a flow chart for handling musical events.

Referring to FIG. 5, shown is a flowchart of the steps of the present invention. The local performance station 10 initializes communication with at least one remote performance station 12, 14, 16, and populates the delay table (212 or 222, as appropriate to the utilization of a fanout server 18) as previously described. Once so initialized, the local performance station awaits the occurrence of a local or remote event.

A local event occurs 510 from keyboard or controls 100. Event interpretation 110 evaluates the event 520 to evaluation whether it is a musical event. If not, the event is passed 522 to other event handlers.

If the event is a miusical event, the jam status is examined 530. If a jam is in progress, the musical event is sent to the remote performance station(s) by one of two ways: If the system is configured 532 without a fanout server 18, then the musical event is sent 534 to each of the remote performance stations. If the system is configured 532 to employ a fanout server 18, then the musical event is sent 536 to the fanout server.

Whether or not a jam is in progress, the delay value for the local performance station is selected 540. If a jam is in progress, the column for the local performance station of the delay table (212 or 222) is populated, and the largest value in that column is selected. Alternatively, if a maximum supported delay has been set, that delay is used instead.

When no jam is in progress, the delay value is zero. Alternatively, if a maximum supported delay has been set, that value is used instead. This permits a musician to practice alone, but to have a delay in the playing of musical events be the same or similar to the delay when a jam is in progress.

Once a musical event has waited for a duration equal to the delay value, the musical event is played 560.

A remote musical event occurs 570 when it is received by the local performance station. It is possible for messages to be received that are non-musical or otherwise not intended for the performance station software. Such messages have been directed elsewhere by the receive module 160 to be handled.

As previously described, the delay value is selected 580. The delay value depends upon which remote performance station originated the musical event.

If a maximum supported delay has been set, then the delay value is compared 582 to the maximum supported delay. If the delay value exceeds the maximum supported delay, the remote musical event is not played 590.

Otherwise, because no maximum supported delay is set or the delay value does not exceed the maximum supported delay, the musical event is held for the delay time 550, and subsequently played 560.

An alternative step 582 would allow a musical event having a delay value that exceeds a maximum supported delay to be played immediately 560 with no hold step 550. In another embodiment, the alternative step 582 would allow musical events having an excessive delay value to be played immediately 560, but only if the delay value is within a preset threshold of the maximum supported delay.

During a jam, it will usually be the case that communication channel 150 is the most efficient avenue available for communication between the participating musicians. As such, the ability for the musicians to communicate other than through musical events is highly desirable. Many techniques are well known in the prior art for a modem to allow voice, as well as data, communication. Too, Internet or other network connections with sufficient speed to permit a voice protocol are commonplace. For example, as shown in APPENDIX B, Microsoft's DirectPlay API makes the inclusion of voice packets easy.

A musician's voice is captured by a microphone (not shown) and digitized at remote station 12. Packets of the digitized voice, perhaps 1/10 of a second long, each, are compressed and buffered. When no musical events are pending, the next voice packet is inserted into the message stream at transmit module 130'. The voice packet is received at the local performance station 10. When it is identified by receive module 160, it is passed as a non-musical message to a voice packet buffer (not shown). When enough voice packets are received, a process (not shown) begins the decompression of the remote musician's voice, which is sent to audio output 190.

Preferably, the voice capture and transmit process is controlled using a conventional push-to-talk intercom switch. A good choice is to assign the spacebar of the keyboard as this intercom switch. Alternatively, a talk-to-talk mechanism can be used, where, if the audio level detected by the microphone exceeds some threshold, then voice packets start getting compressed and buffered for sending. If the audio level drops for too long a period of time, no more voice packets are prepared.

While the preferred embodiment is discussed in the context of present day GUI displays, keyboards, MIDI controllers, and communications channels, it is contemplated that other modes of input and communications will be suitable as they are made available.

The particular implementations described, and the discussions regarding details, and the specifics of the figures included herein, are purely exemplary; these implementations and the examples of them, may be modified, rearranged and/or enhanced without departing from the principles of the present invention.

The particular features of the user interface and the performance of the application, will depend on the architecture used to implement a system of the present invention, the operating system of the computers selected, the communications channel selected, and the software code written. It is not necessary to describe the details of such programming to permit a person of ordinary skill in the art to implement an application and user interface suitable for incorporation in a computer system within the scope of the present invention. The details of the software design and programming necessary to implement the principles of the present invention are readily understood from the description herein. However, in the interest of redundancy, two exemplary implementations are included in APPENDICES A & B.

Various additional modifications of the described embodiments of the invention specifically illustrated and described herein will be apparent to those skilled in the art, particularly in light of the teachings of this invention. It is intended that the invention cover all modifications and embodiments which fall within the spirit and scope of the invention. Thus, while preferred embodiments of the present invention have been disclosed, it will be appreciated that it is not limited thereto but may be otherwise embodied within the scope of the following claims.

We claim as our invention:

1. A musical performance station for use by a musician, said station comprising:

a keyboard for the musician to play, said keyboard generating a local musical event in response to being played by the musician;

a communication channel interface, said interface providing access through a communication channel to at least one remote musical performance station, said access to each of the at least one remote musical performance station having an associated latency, said interface sending the local musical event from the keyboard to the at least one remote musical performance station, said interface further receiving a remote musical event from the at least one remote musical performance station;

a delay, said delay having a non-zero local delay value, said delay receiving the local musical event from the keyboard and holding the local musical event for a first amount of time specified by the local delay value, said delay further having a remote delay value associated with each of the at least one remote musical performance station, said delay receiving the remote musical event from the communication channel interface and holding the remote musical event for a second amount of time specified by the remote delay value associated with the remote musical performance station which originated the remote musical event; and, a synthesizer for rendering musical events into an audio signal, said synthesizer receiving the local musical event from the delay when the first amount of time has elapsed, and rendering the local musical event into the audio signal, said synthesizer receiving the remote musical event from the delay when the second amount of time has elapsed, and rendering the remote musical event into the audio signal.

2. The musical performance station of claim 1, in which the local delay value is set to the greatest latency.

3. The musical performance station of claim 1, in which each remote delay value is set to the greatest latency less the latency associated with the respective remote performance station.

4. The musical performance station of claim 1, in which the local delay value is determined by the musician, and each remote delay value is set to the larger of zero and the local delay value less the latency associated with the respective remote performance station.

5. The musical performance station of claim 4, in which the delay discards the remote musical event when the latency associated with the respective remote performance station exceeds the local delay value.

6. The musical performance station of claim 4, in which the delay discards the remote musical event when the latency associated with the respective remote performance station exceeds the local delay value by more than a threshold value set by the musician.

7. The musical performance station according to any one of claims 1, 2, or 3, further comprising:

a groove track, said groove track having a like groove track on each of the at least one remote musical performance station, and in which the local musical event represents a command to start the groove track, said synthesizer rendering the groove track into the audio signal upon receiving the local musical event.

8. The musical performance station according to any one of claims 1, 2, or 3, further comprising:

a groove track, said groove track having a like groove track on each of the at least one remote musical performance station, and in which the remote musical event represents a command to start the groove track, said synthesizer rendering the groove track into the audio signal upon receiving the remote musical event.

9. The musical performance station of claim 1, further comprising:

a local clock, and wherein each of the at least one remote musical performance station has a remote clock, said local musical event including the value of the local clock at the time the local musical event is generated, said remote musical event including the value of the respective remote clock at the time the remote musical event is generated, said remote delay value being calculated as the local delay value less the mean latency associated with the respective remote performance station less the difference between the local clock at the time the remote musical event is received and the value of the respective remote clock contained in the remote musical event plus the difference between the local clock and the respective remote clock.

10. The musical performance station of claim 9, in which the local delay value is set to the greatest latency.

11. The musical performance station of claim 9, in which the local delay value is determined by the musician.

12. The musical performance station according to any one of claims 9, 10, or 11, in which the delay discards the remote musical event when the remote delay value is negative.

13. The musical performance station according to any one of claims 9, 10, or 11, in which the delay discards the remote musical event when the remote delay value is more negative than a threshold value set by the musician.

14. The musical performance station according to any one of claims 1, 2, 3, 4, 5, 6, 9, 10, or 11, wherein the communication channel interface directs the local musical event to each of the at least one remote musical performance station.

15. The musical performance station according to any one of claims 1, 2, 3, 4, 5, 6, 9, 10, or 11, wherein the communication channel interface of the musical performance station directs the local musical event to a fanout server, said fanout server being operatively connected to the communication channel, the fanout server forwarding the local musical event to each of the at least one remote musical performance station, and wherein the remote musical event is communicated to the musical performance station by way of the fanout server.

16. A method for real time, distributed, musical performance by multiple musicians, comprising the steps of:

creating a local musical event, advancing the local musical event through a communication channel having access to at least one remote location, said access to each of the at least one remote location having an associated latency, receiving through the communication channel, from the at least one remote location, a remote musical event, delaying the local musical event by a non-zero first amount of time, delaying the remote musical event by a second amount of time associated with the remote location which originated the remote musical event, playing the local musical event when the first amount of time has elapsed, and playing the remote musical event when the second amount of time has elapsed.

17. The method of claim 16, wherein the first amount of time equals the greatest latency.

18. The method of claim 16, wherein the second amount of time equals the greatest latency less the latency associated with the remote location which originated the remote musical event.

19. The method of claim 16, in which the first amount of time is determined by the musician, and the second amount of time equals the larger of zero and the first amount of time less the latency associated with the remote location which originated the remote musical event.

20. The method of claim 19, further comprising a step in which the remote musical event is discarded without being played when the latency associated with the remote location which originated the remote musical event exceeds the first amount of time.

21. The method of claim 19, further comprising a step in which the remote musical event is discarded without being played when the latency associated with the remote location which originated the remote musical event exceeds the first amount of time by more than a threshold value set by the musician.

22. The method according to any one of claims 16, 17, or 18, in which the local musical event represents a command to start playing a groove track available locally and at each of the at least one remote location.

23. The method according to any one of claims 16, 17, or 18, in which the remote musical event represents a command to start playing a groove track available locally and at each of the at least one remote location.

24. The method of claim 16, wherein said remote musical event is augmented with the value of a respective remote clock at the time the remote musical event is generated, and further comprising the steps of:

augmenting the local musical event with the value of a local clock at the time the local musical event is generated, and calculating said second amount of time as the first amount of time less the mean latency associated with the respective remote location less the difference between the local clock at the time the remote musical event is received and the value of the respective, remote clock contained in the remote musical event plus the difference between the local clock and the respective remote clock.

25. The method of claim 24, in which the first amount of time is equal to the greatest latency.

26. The method of claim 24, further comprising the step of:

the first amount of time being set by the musician.

27. The method according to any one of claims 24, 25, or 26, further comprising the step of:

discarding the remote musical event when the second amount of time is negative.

28. The method according to any one of claims 24, 25, or 26, further comprising the step of:

discarding the remote musical event when the second amount of time is more negative than a threshold value set by the musician.

29. The method according to any one of claims 16, 17, 18, 19, 20, 21, 24, 25, or 26, wherein the step of advancing the local musical event comprises separately sending the local musical event to each of the at least one remote location.

30. The method according to any one of claims 16, 17, 18, 19, 20, 21, 24, 25, or 26, wherein the step of advancing the local musical event comprises the steps of:

sending the local musical event to an intermediate location, and forwarding the local musical event from the intermediate location to each of the at least one remote location.

* * * * *